US005253830A

United States Patent [19]

Nayer et al.

[11] Patent Number: 5,253,830

[45] Date of Patent: Oct. 19, 1993

[54] METHOD FOR MONITORING THE CONDITION OF RAIL SWITCH POINTS

[75] Inventors: Wolfgang Nayer; Gerald Durchschlag, both of Zeltweg, Austria

[73] Assignee: Voest-Alpine Eisenbahnsysteme Gesellschaft m.b.H., Vienna, Austria

[21] Appl. No.: 880,420

[22] Filed: May 8, 1992

[30] Foreign Application Priority Data

May 8, 1991 [AT] Austria ..... 957/91

[51] Int. Cl.[5] ..... B61L 5/10

[52] U.S. Cl. ..... 246/220; 246/162

[58] Field of Search ..... 246/121, 162, 176, 220, 246/476

[56] References Cited

U.S. PATENT DOCUMENTS

| | | | |
|---|---|---|---|
| 975,922 | 11/1910 | Adams | 246/220 X |
| 2,740,041 | 3/1956 | Marcum | 246/220 |
| 4,207,569 | 6/1980 | Meyer | 246/121 X |
| 4,986,498 | 1/1991 | Rotter et al. | 246/220 X |
| 5,116,006 | 5/1992 | Ocampo | 246/220 |

FOREIGN PATENT DOCUMENTS

| | | | |
|---|---|---|---|
| 2630387B2 | 1/1978 | Fed. Rep. of Germany . | |
| 3511891A1 | 10/1986 | Fed. Rep. of Germany . | |
| 415246 | 9/1910 | France | 246/162 |
| 598866 | 12/1925 | France | 246/162 |
| 629299 | 11/1927 | France | 246/220 |
| 663389 | 1/1984 | Switzerland . | |
| 2135802 | 1/1984 | United Kingdom . | |

*Primary Examiner*—Frank E. Werner
*Assistant Examiner*—Scott L. Lowe
*Attorney, Agent, or Firm*—Cushman, Darby & Cushman

[57] ABSTRACT

In a method for monitoring the condition of rail switch points and for detection of premature abrasive wear-and-tear in the region of the tongue switching rail (3) of the points, the signals from at least one proximity sensor (2) in the region of the tongue switching rail (3) of the points are evaluated when the tongue switching rail is travelled upon, and the smallest measured value of the separation distance (l) during the travel is stored in memory. The smallest measured value stored in memory and at least a first limiting value for the smallest separation distance are compared with one another and, when the smallest measured value in memory exceeds this first limiting value, a warning signal is generated.

7 Claims, 2 Drawing Sheets

METHOD FOR MONITORING THE CONDITION OF RAIL SWITCH POINTS

BACKGROUND OF THE INVENTION

1. Field of the Invention

The present invention relates to a method for monitoring the condition of rail switch points and for detecting premature abrasive wear-and-tear in the region of the tongue switching rail of the rail switch points.

2. Description of the Related Art

A positioning, safety and monitoring device has already become known from the German Patent DE 364891A1, wherein a plurality of point drives, having an internal closure, driven by electric motors are employed. By a series of sensors, in these known devices, the currently-involved end position of the slide member, and its safety position, are monitored. A series of such units are combined in functional zones and in all cases are controlled and monitored in common. In particular, details of a monitoring device for the end positions of swivelling rails of rail switch points may be gleaned from DE 2630387B2, wherein switches are provided for both end positions of each swivelling rail. In this case, an evaluation device for signalling a correct end position includes the involvement of all the switches of every rail for one end position and the simultaneous non-involvement of all the switches for the corresponding other end position.

In the known utilization of sensors on rail switch points, the final setting position is monitored in each case, in order to ensure safety when said switch points are travelled upon. However, safe travelling over a switch point is still possible if an end position is maintained within a pre-determined tolerance. Within the range of this pre-determined tolerance, it is true that abrasion phenomena in the region of contact with the running wheels can bring about measurable changes which, in the case of known devices, cannot be detected. An excessive amount of abrasive wear-and-tear in the region of rail switch points is only detected by the known devices when the safety of the points could no longer be relied upon. When this occurs, the maintenance work is substantially more involved and expensive, resulting in essentially longer periods of non-use.

SUMMARY OF THE INVENTION

An object of the present invention is thus the further development of a method, of the type referred to initially, in such a manner that abrasion phenomena are recognized with certainty before it is no longer safe for a train to travel over the points. To achieve this object, the present invention evaluates the signals from at least one proximity sensor in the region of the rail switch points when the rails switch points are being travelled upon, and that the smallest measured value of the separation distance when the rail switch points are being travelled upon is stored in memory. The smallest measured value stored in memory and at least a first limiting value for the smallest separation distance are compared with one another and, when this first limiting value is exceeded, a warning signal is generated. To assure safe travel over the points, a maximum separation distance of the tongue profile of the stock rail may not be exceeded with this method, during travel over the points, the signals from a proximity sensor in the region of the tongue switching rail can be evaluated, and an additional evaluation can be performed when the smallest value for the separation distance, measured during travel over the points, is stored in memory. Such smallest value of the separation distance corresponds, as a general rule, to a value at which safe travel over the points is in no way questionable. Because the smallest measured value stored in memory is compared with a first limiting value, it is possible at a premature stage, to recognize the formation of a burr. That is, even if the first limiting value equals the smallest value during travel over the points, this does not indicate that travel over the rail switch points is unsafe. When this first limiting value is exceeded, it is possible, in accordance with the present invention, for a warning signal to be generated and then, at such an early time, the cost of maintenance is substantially less and there is no lengthy disruption operation to repair damaged caused by excessive grinding of the corresponding contact sites of the tongue switching rail on the stock rail. In particular, the monitoring of the alteration of the measured smallest value over a period of time makes it possible to assess the type of abrasive wear and tear at an early stage at which the operational safety of the switch points is still fully ensured.

The method, in accordance with the present invention, is advantageously employed when the measured values of the smallest separation distance of the tongue from the stock rail is monitored at a point at which the upper edge of the tongue switching rail lies, in the unworn state, at a level higher than 14 millimeters below the upper border of the stock rail or the inner side of the rail head. A proximity sensor disposed at a position at which the upper edge of the tongue switching rail lies lower than the given limiting value, would produce false results, because, at this point, a collision of the bearing surface of the wheel with the upper edge of the tongue switching rail is not anticipated. Measured values at such positions can therefore only give unsatisfactory information about the possibility of burr formation, because burr formation on the running contact surface of the stock rail at these locations does not lead, of course, to an alteration of the end position of the tongue switching rail. The choice of the appropriate position for the proximity sensors is thus of essential significance for determining the possibility of burr formation.

It is an advantage to utilize this type of operational procedure at the same time in order to subject the safety of the points to additional control. Note that achieving the first limiting value for the smallest separation distance between the tongue rail and the stock rail during travel over the points does not inherently provide any information about the safety of the travel, because the first limiting value is selected to be substantially smaller than the permissible tolerance for safety during travel over the points. However, in compliance with a preferred embodiment of the method in accordance with the present invention, at least a second larger limiting value for the separation distance between the tongue rail and the stock rail is compared with the measured distance, and a warning signal is given when the second limiting value is exceeded. This warning signal can be used directly for preventing further travel over the switch points.

The method can be employed in an especially simple manner so that the sensor signal is converted to a digital signal by an A/D-converter and is transmitted to a minimal-value storage memory. The memory contents of the minimal-value memory, after a period of time, is compared with the limiting value, where this period of time is longer than the period of time between successive scanning of the sensor signal. The digitalization of the sensor signal, before further processing, makes it possible to transmit the signal over lengthier signal conductors without the danger of distortion of the signal and therefore allows the evaluation circuit to be disposed at an appropriate distance away from the rail points and, in this manner, be protected from external interference. Because this type of signal is conveyed to a minimal-value storage memory, it is possible to utilize simple storage-memory components and compare only the contents of the minimal-value storage memory, after a period of time, with the limiting value when said period of time is longer than the period of time between successive scanning of the sensor signal, so that the cost of computation for the comparison is substantially reduced. At the same time it is ensured that actually a smallest value is detected, because a plurality of sensor values are transmitted to the minimal-value storage memory and in this way the detection of a minimum value is facilitated.

With this method, it is possible to proceed in sequence so that the minimal-value storage memory, after comparison of the memory contents with the limiting value, can be re-set, and so that the result of the comparison with the limiting value or the detected minimal-value can be stored separately. In this manner, without using excessive amounts of storage memory, alteration of the smallest value over a prolonged period of time can be detected, so that it is possible to make preliminary assessments or prognoses of critical burr formation in the zone of travel or on the stock rail.

BRIEF DESCRIPTION OF THE DRAWINGS

The invention will now be described in greater detail with reference to the accompanying diagrammatic representations of examples of embodiment, in which.

DETAILED DESCRIPTION OF THE PREFERRED EMBODIMENT

Figure 1:
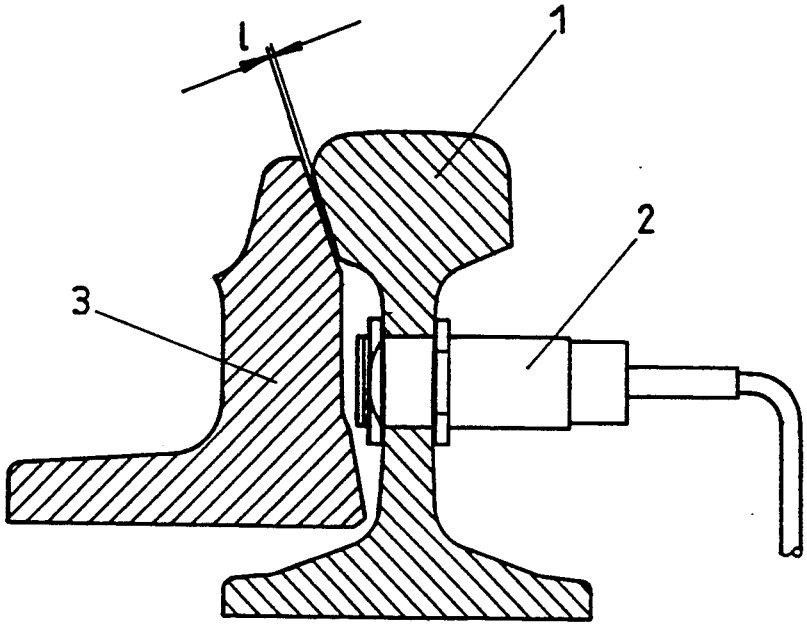
FIG. 1 is a section through a stock rail and a tongue rail in the region of location of a sensor.

In FIG. 1, a stock rail designated as 1, has a proximity sensor 2 mounted in its web. This type of proximity sensor may be configured as an analog sensor and may be wired as an inductive or capacitive sensor. The signal from this type of sensor 2 depends upon the separation distance of the end surface of the sensor away from a component approaching this end surface, which, in the case depicted in FIG. 1, is represented by a tongue rail 3. When there is ideal contact of the tongue rail 3 with the stock rail 1, the contact surfaces lie flat against each other, so that there is no gap left between these surfaces. In the case of deformation of the stock rail in its head region or of the tongue rail in the region over which the wheel runs, a gap l will develop between the surfaces of the tongue rail 3 and the stock rail 1 which should be in contact, and this gap will become correspondingly greater depending upon the magnitude of the burr formation arising from the deformation. A critical separation distance or gap l can be recognised by the sensor 2, where such a critical separation distance l may be substantially smaller than an additional critical separation distance which will no longer guarantee the safety of travel over the rail points.

It may be seen from FIG. 2 that the signal from the sensor 2 is first transmitted to an analog-digital converter 4 and subsequently to a minimal-value storage memory 5. At regular intervals of time, the contents of the minimal-value storage memory 5 are subjected to comparison with a limiting value in a comparator circuit 6.

Depending upon the wiring of the analog-digital converter, current or voltage signals may be converted. In the case of the configuration depicted in FIG. 2, a working resistance 7 may be employed, across which a certain voltage drop occurs, depending upon the sensor current.

Figure 2:
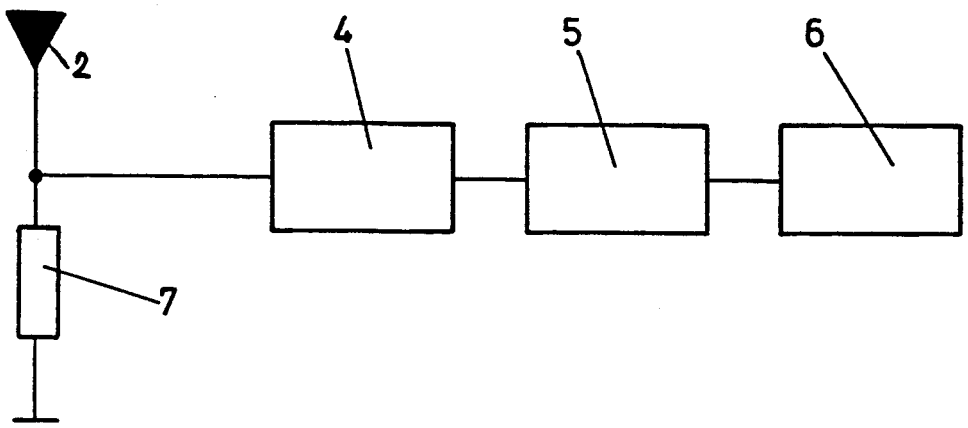
FIG. 2 is a diagrammatic representation of a first circuit arrangement for evaluating measured values from the sensor as shown in FIG. 1.

In the configuration depicted in FIG. 2, by way of example, using a scanning frequency of 1 Khz, the sensor signal may be conveyed by way of a rapid analog-digital converter 4 to a minimal-value storage memory 5 and once each day, a limiting value comparison is carried out, which is then stored separately over a prolonged period of time. In this manner, it is possible to detect an increase in the minimal-value l.

The digital minimal-value storage memory 5 may be re-set daily, and because of the high scanning frequency, the minimal value is established with a high degree of certainty.

With an analog configuration, such as depicted in FIG. 2, it is possible to work with a lower scanning frequency and, by way of example, the sensor signals may be observed over a longer period of time. Likewise, over a correspondingly longer period of time, the smallest value can be established with certainty and correspondingly evaluated.

Figure 3:
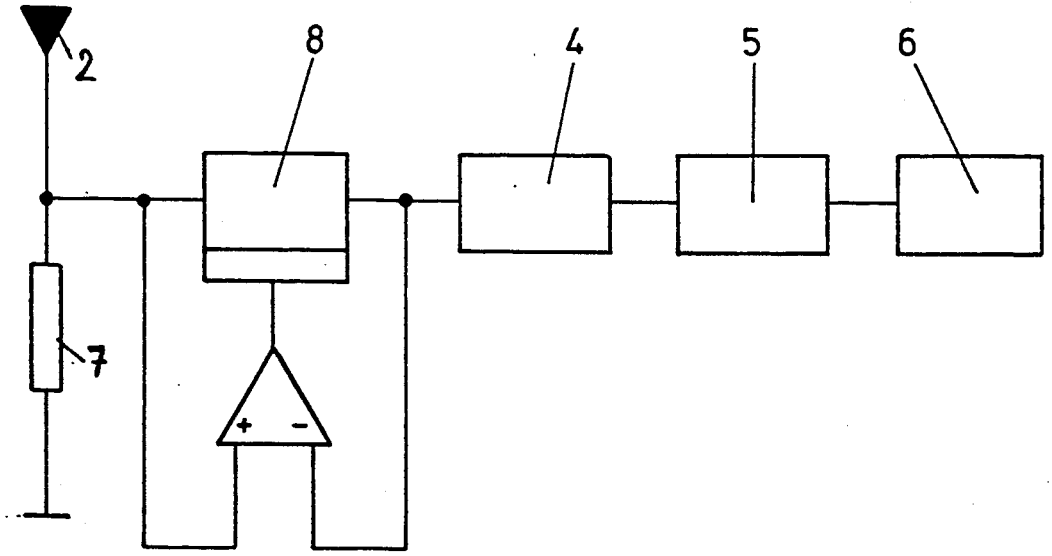
FIG. 3 is an alternate embodiment of the configuration of such type of evaluation circuit.

Using the configuration depicted in FIG. 3, the signal from the sensor 2 may be stored as an analog value and may be interrogated in the system cycle. The corresponding circuit (sample and hold) is designated as 8.A read-out of the analog minimal value is effected subsequently at substantially longer intervals of time, where, after analog-digital conversion in an appropriate analog-digital converter 4, once again the storage in a minimal-value storage memory 5 can be effected. The limiting value comparator circuit is again designated as 6.

The output signal from the tongue-rail position sensor can be set at 0 (zero) during the test mounting when the tongue rail is in completely smooth contact with the stock. As soon as there is any burr formation, a minimal value of 0 can no longer be achieved, so that after an increase of this separation distance, it is true that, when compared with the maximum permissible value, it appears that travel over the points can be permitted with a high degree of safety, but recognition of defects and, in particular, burr formation is only made possible when smaller increases in this separation distance are also detected. For example, exceeding the maximum value by 3 millimeters must always be regarded as critical for reasons of safety and must lead to interruption of the use of the switch points. Also, it has been demonstrated that by proper overhauling of the components which display a tendency towards burr formation, with a predetermined first limiting value, for example, with a separation distance l of approximately 1.5 millimeters, interruption-free operation is possible, which, with adequate difference of the safety separation distance from the critical separation distance, substantially decreases the maintenance costs.

We claim:

1. A method for monitoring a condition of a rail switch point and for detecting premature abrasive wear-and-tear in a region of a tongue switching rail and a stock rail of the rail switch point, comprising the steps of:

successively detecting signals, provided by at least one proximity sensor disposed in a region of the tongue switching rail, said signals representing a separation distance between the tongue switching rail and the stock rail during at least a period of time when the rail switch point is being travelled upon;

storing in a memory a measured value representative of one of the signals detected during the detecting step, said measured value representing a minimum separation distance;

comparing the measured value stored in the memory to, at least a first limiting value to obtain a result value; and generating a first warning signal when the measured value stored in the memory is greater than the first limiting value compared thereto.

2. The method according to claim 1, wherein the measured values of the staring step represent the separation distance between the tongue switching rail and the stock rail at an upper edge of the tongue switching rail.

3. The method according to claim 1 or 2, further comprising the steps of:

comparing at least a second limiting value, larger than the first limiting value, to the measured value stored in the memory; and generating a second warning signal when the measured value stored in the memory is greater than the second limiting value compared thereto.

4. The method according to claims 1 or 2, further comprising the steps of:

converting the signals detected during the detecting step to digital signals; and transmitting the digital signals to the memory, the memory being a minimum-value storage memory; and wherein the comparing step compares the measured value stored in the memory to the first limiting value after a period of time has elapsed, said period of time being longer than a period of time between the successive detecting of the signals provided by the sensor.

5. The method according to claim 4, further comprising the steps of:

clearing the memory after performing the comparing step; and storing either the result value obtained by the comparing step or the measured value.

6. The method according to claim 3, further comprising the steps of:

converting the signals detected during the detecting step to digital signals; and transmitting the digital signals to the memory, the memory being a minimum-value storage memory; and wherein the comparing step compares the measured value stored in the memory to the first limiting value after a period of time has elapsed, said period of time being longer than a period of time between the successive detecting of the signals provided by the sensor.

7. The method according to claim 6, further comprising the steps of:

clearing the memory after performing the comparing step; and storing either the result value obtained by the comparing step or the measured value.

* * * * *